US005578973A

United States Patent [19]

Tokouzbalidis et al.

[11] Patent Number: 5,578,973

[45] Date of Patent: Nov. 26, 1996

[54] WAVEGUIDE MULTIPLEXER/DEMULTIPLEXER

[75] Inventors: Stilianos Tokouzbalidis, Backnang; Uwe Rosbenberg, Aspach; Werner Speldrich, Backnang, all of Germany

[73] Assignee: Ant Nachrichtentechnik GmbH, Backnang, Germany

[21] Appl. No.: 535,128

[22] PCT Filed: Mar. 18, 1994

[86] PCT No.: PCT/DE94/00302

§ 371 Date: Dec. 24, 1995

§ 102(e) Date: Dec. 24, 1995

[87] PCT Pub. No.: WO94/24721

PCT Pub. Date: Oct. 27, 1994

[30] Foreign Application Priority Data

Apr. 10, 1993 [DE] Germany ..... 43 11 853.4

[51] Int. Cl.[6] ..... H01P 1/213

[52] U.S. Cl. ..... 333/135; 333/137

[58] Field of Search ..... 333/125, 126, 333/135, 137

[56] References Cited

U.S. PATENT DOCUMENTS 3,731,235 5/1973 Ditullio et al. ..... 333/135
3,845,415 10/1974 Ando ..... 333/135
3,952,270 4/1976 Louvel .
4,060,778 11/1977 Hefni et al. .
4,614,920 9/1986 Tong ..... 333/135

FOREIGN PATENT DOCUMENTS 987593 3/1965 United Kingdom .

*Primary Examiner*—Paul Gensler
*Attorney, Agent, or Firm*—Michael J. Striker

[57] ABSTRACT

The waveguide multiplexer/demultiplexer includes a rectangular collecting waveguide provided with a short-circuit plane at one end thereof and elements for coupling the collecting waveguide to tunable waveguide filters arranged on opposing sidewalls, which are tunable to different frequency channels. The sidewalls are each provided with at least one pair of coupling openings. The two coupling openings of each pair are arranged side-by-side in a transverse direction relative to the waveguide longitudinal axis. Each coupling opening is spaced from the short-circuit plane at a distance corresponding to an odd-numbered multiple of a quarter mean wavelength for the frequency channel to be coupled via the respective coupling openings, and the two coupling openings of each pair are sufficiently spaced from the center of the sidewall transversely towards respective longitudinal edges of the sidewall so that one of the two waveguide filters for the two coupling openings can be coupled to the collecting waveguide via the coupling opening of the one waveguide filter when the two waveguide filters are tuned to different frequencies.

4 Claims, 1 Drawing Sheet

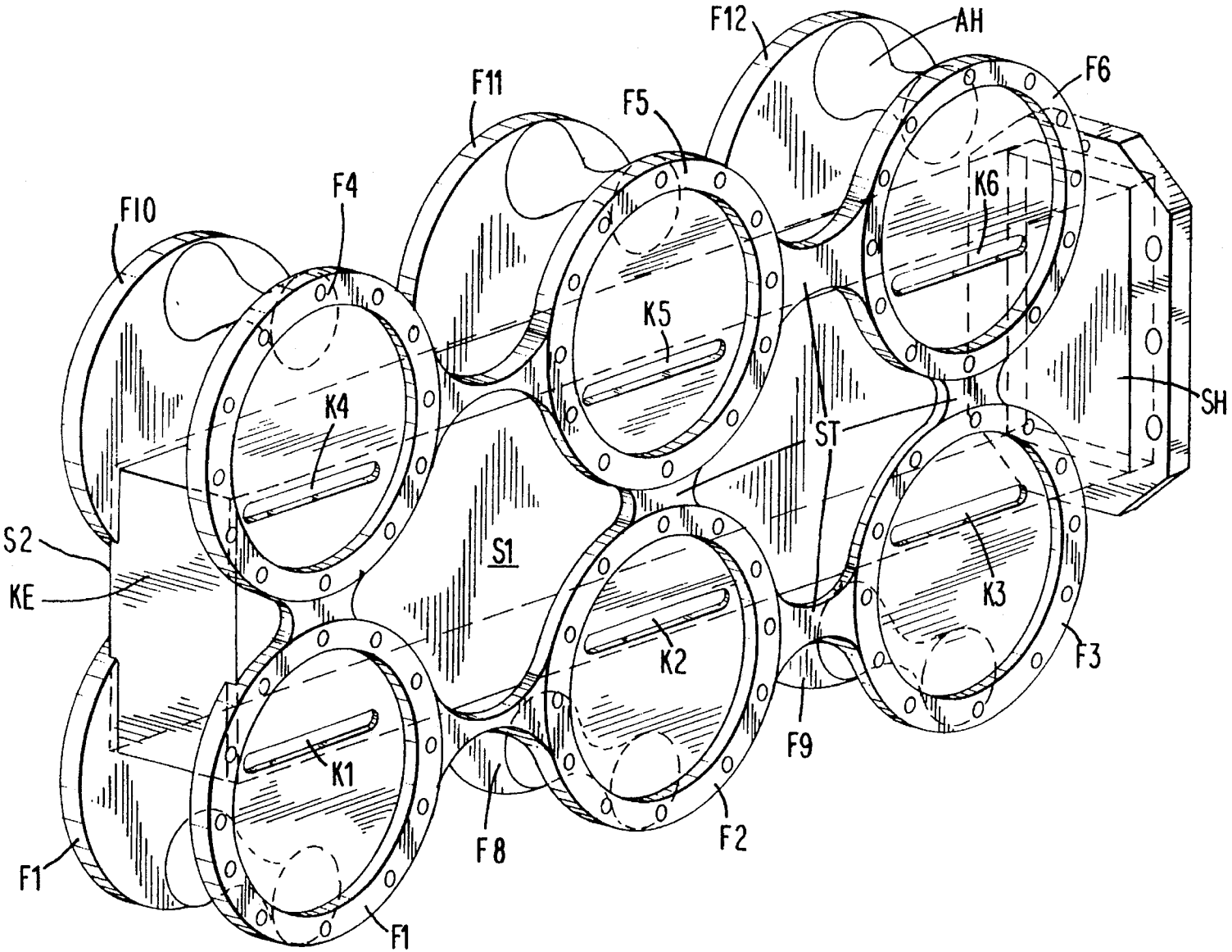
SH
F6
F3
K6
K3
AH
ST
F9
F12
F2
F5
K5
K2
S1
F11
F8
F1
F4
K4
K1
F10
S2
KE
F1

WAVEGUIDE MULTIPLEXER/DEMULTIPLEXER

BACKGROUND OF THE INVENTION

The invention is based on a waveguide multiplexer/demultiplexer. A waveguide multiplexer/demultiplexer is known comprising a rectangular collecting waveguide short-circuited at one end and coupled to a plurality of tunable waveguide filters at least on one of its sidewalls, the waveguide filters being tunable to different frequency bands.

Such a waveguide multiplexer/demultiplexer has been disclosed in PCT Application WO 88/03711. Here, two waveguide filters are in each case coupled in the same cross-sectional plane to the collecting waveguide, to be precise in each case one waveguide filter to one of two mutually opposite side walls. The coupling is effected via pins which project on one end into the collecting waveguide and on the other end into the waveguide filter, through its side walls. The same document also discloses a waveguide multiplexer/demultiplexer in the case of which waveguide filters are coupled at the ends via slots in two mutually opposite side walls of a collecting waveguide. The waveguide filters are alternately coupled along the collecting waveguide to the opposite side walls, so that there is always a coupling opening for a waveguide filter in a cross-sectional plane of the collecting waveguide.

This known type of coupling of waveguide filters to a collecting waveguide results in an extremely long physical length of the multiplexer/demultiplexer, particularly if it is intended to be designed for a very large number (for example 12) of frequency channels. Since such waveguide multiplexers/demultiplexers are used in the field of space flight, it is disadvantageous if their physical shapes are very voluminous.

SUMMARY OF THE INVENTION

It is an object of the present invention to provide a waveguide multiplexer/demultiplexer of the type mentioned initially which has a volume and weight which are as small as possible.

According to the invention, the waveguide multiplexer/demultiplexer comprises a rectangular collecting waveguide provided with a short-circuit plane at one end thereof and a device or elements for coupling the collecting waveguide to a plurality of tunable waveguide filters arranged on at least one of its sidewalls, the waveguide filters being tunable to different frequency channels. The at least one sidewall is provided with at least one pair of coupling openings. The two coupling openings of each pair are arranged in a side-by-side relationship in a transverse direction relative to a longitudinal axis of the collecting waveguide. Each coupling opening is spaced from the short-circuit plane at a distance corresponding to an odd-numbered multiple of a quarter mean wavelength for the frequency channel to be coupled via the respective coupling openings, and the two coupling openings of each pair are sufficiently offset or spaced from a center of the at least one sidewall of the collecting wave guide transversely towards respective longitudinal edges of the at least one sidewall so that one of the two waveguide filters for the two coupling openings can be coupled to the collecting waveguide via the coupling opening of the one waveguide filter when the two waveguide filters are tuned to different frequencies.

In a preferred embodiment of the invention the waveguide has two mutually opposing sidewalls and each mutually opposing sidewall is provided with at least one pair of coupling openings. The coupling openings can be slots provided in the at least one sidewall and elongated in a direction along the longitudinal axis of the collecting waveguide. Each of the coupling openings is in a preferred embodiment surrounded by a flange for connection to one of the waveguide filters. In a waveguide multiplexer/demultiplexer which is designed in accordance with the invention, the space for coupling the waveguide filters to the collecting waveguide is used in an optimum manner. In consequence, the overall length of the arrangement is considerably shortened in comparison with that of the prior art. As a consequence of this, the weight of the arrangement is also reduced.

BRIEF DESCRIPTION OF THE DRAWING

The invention will now be explained in more detail using an exemplary embodiment which is illustrated in the drawing.

DESCRIPTION OF THE PREFERRED EMBODIMENT

The single figure of the drawing shows a 12-channel waveguide multiplexer/demultiplexer. This has a rectangular collecting waveguide SH, which is provided with a short-circuit KE at one end. In order to couple waveguide filters, which are not illustrated in the drawing, and each of which is tuned to one of 12 frequency channels, coupling openings K1, K2, K3, K4, K5, K6 . . . are incorporated in two mutually opposite sidewalls S1 and S2 of the collecting waveguide. These coupling openings have, for example, the form of slots in the illustrated exemplary embodiment, which slots make very broadband coupling possible.

Two coupling openings K1 and K4, K2 and K5, K3 and K6 are arranged side by side in the transverse direction T with respect to the longitudinal axis L of the collecting waveguide in each of the two side walls S1 and S2 of the collecting waveguide SH. To be precise, the two coupling openings, or spaced a distance O, are offset from the center C of the sidewall S1, S2 towards its respective longitudinal edges e so that it is possible to couple waveguide filters to the collecting waveguide SH side by side via the two coupling openings. As the figure shows, a plurality of such coupling opening pairs K1, K4 and K2, K5 and K3, K6 are arranged along the collecting waveguide SH, it being possible for coupling opening pairs to be directly opposite one another in both side walls S1 and S2, as well. Each coupling opening K1, K2, K3, K4, K5, K6 . . . is positioned such that the distance $d_1$, $d_2$ between its center and the short-circuit plane KE of the collecting waveguide SH corresponds approximately to an odd-numbered multiple of a quarter of the mean wavelength of the frequency channel which is to be coupled via it.

In order that undesired couplings between the individual frequency channels are precluded as far as possible, the coupling openings are expediently assigned to the frequency channels such that physically closely adjacent coupling openings, such as the coupling openings K1, K4 or K2, K5 or K3, K6 which are located side by side transversely with respect to the waveguide longitudinal axis L, are not provided for the coupling of directly adjacent frequency channels. The designation of the coupling openings K1 . . . K6 in the drawing indicates that coupling openings which are located closely side by side have a frequency channel separation which is as large as possible (the frequency channels which are arranged in sequence are numbered successively from 1 to 12).

Each coupling opening K1, K2, K3, K4, K5, K6 . . . is surrounded by a flange F1 . . . F12. As a result of the space-saving arrangement of the coupling opening, the flanges project to some extent beyond the edges of the collecting waveguide SH. In order to give all the flanges sufficient stability, webs ST and spacers AH are provided between adjacent flanges.

One or more further filters can also be coupled directly in the short-circuit plane KE by coupling apertures being provided in the short-circuit wall, which coupling apertures are oriented parallel to the magnetic field component of the fundamental wave type in the collecting waveguide SH.

We claim:

1. A waveguide multiplexer/demultiplexer comprising a rectangular collecting waveguide (SH), said collecting waveguide having a short-circuit plane (KE) at one end thereof, at least one sidewall, a longitudinal axis (L) and means for coupling the collecting waveguide to a plurality of tunable waveguide filters on the at least one sidewall, the waveguide filters each being tunable to different frequency channels;

wherein said at least one sidewall is provided with at least one pair of coupling openings (K1,K4; K2,K5; K3,K6), said coupling openings of each of said at least one pair are arranged in a side-by-side relationship in a transverse direction (T) relative to said longitudinal axis (L) of said collecting waveguide, each of said coupling openings (K1,K4; K2,K5; K3,K6) is spaced from the short-circuit plane (KE) at a distance ($d_1$,$d_2$) corresponding to an odd-numbered multiple of a quarter of a mean wavelength for the frequency channel to be coupled via the respective coupling opening, and the two coupling openings (K1,K4; K2,K5; K3,K6) of each of said at least one pair are sufficiently offset (o) from a center (c) of said at least one sidewall of the collecting wave guide (SH) transversely towards respective longitudinal edges (e) of said at least one sidewall so that one of the two waveguide filters for said two coupling openings can be coupled to said collecting waveguide (SH) via said coupling opening of said one of the two waveguide filters when said two waveguide filters are tuned to different frequencies.

2. The waveguide multiplexer/demultiplexer as defined in claim 1, wherein said at least one sidewall consists of two mutually opposing walls (S1,S2) and each of said two mutually opposing walls (S1,S2) is provided with at least one of said pairs of said coupling openings (K1,K4; K2,K5; K3,K6).

3. The waveguide multiplexer/demultiplexer as defined in claim 1, wherein each of said at least one pair of said coupling openings (K1,K4; K2,K5; K3,K6) arranged side-by-side in said transverse direction (T) is provided for coupling frequency channels not directly adjacent to each other.

4. The waveguide multiplexer/demultiplexer as defined in claim 1, wherein said coupling openings (K1,K4; K2,K5; K3,K6) are slots provided in the at least one sidewall and elongated in a direction of the longitudinal axis (L) of the collecting waveguide (SH) and each of the coupling openings (K1,K4; K2,K5; K3,K6) is surrounded by a flange (F1,F4; F2, F5; F3,F6) for connection to one of the waveguide filters.

* * * * *